US005274616A

United States Patent [19]

Shu

[11] Patent Number: 5,274,616

[45] Date of Patent: Dec. 28, 1993

[54] PERPETUAL CALENDAR STRUCTURE

[76] Inventor: Kuei-Wen Shu, No. 160, Chinchow St., Taipei, Taiwan

[21] Appl. No.: 873,162

[22] Filed: Apr. 24, 1992

[51] Int. Cl.[5] ..... G04B 19/02; G04B 19/20

[52] U.S. Cl. ..... 368/39; 368/80; 368/222

[58] Field of Search ..... 368/28, 39, 76, 77, 368/80, 220, 222, 228, 235; 40/119

[56] References Cited

U.S. PATENT DOCUMENTS

| | | | |
|---|---|---|---|
| 2,670,590 | 3/1954 | Anderson | 368/39 |
| 2,836,956 | 6/1958 | Chadwick | 368/39 |
| 2,927,418 | 3/1960 | Bauer | 368/39 |
| 3,400,510 | 9/1968 | Schwarzer et al. | 368/39 |
| 3,708,972 | 1/1973 | Koide | 368/39 |
| 4,027,469 | 6/1977 | Yaguinuma | 368/39 |
| 4,122,659 | 10/1978 | Hashimoto | 368/78 |
| 4,193,256 | 3/1980 | Tobeta et al. | 368/222 |

*Primary Examiner*—Vit W. Miska

*Attorney, Agent, or Firm*—Bacon & Thomas

[57] ABSTRACT

A perpetual calendar structure comprising an outer casing, an interior frame, a driver, a clock control and a power source including a battery, in which the outer casing has windows for display of date, month, weekday and time, the interior frame in incorporated with a date display set, a month display set, and a weekday display set each aligning with their respective windows, the clock control is aligned with the time display window, and is used to give a signal at the end of each rotation of a cycle of 12-hour period to control the driver to cause a weekday driver to turn the weekday display set to next plate showing a weekday and A.M. or P.M., a date driver to turn the date display set to next plate showing a date after every two weekday plates are turned, and a month driver to turn the month display set to next plate showing a month after 31 date display plates are turned automatically without the need of manual control.

3 Claims, 5 Drawing Sheets

PERPETUAL CALENDAR STRUCTURE

BACKGROUND OF THE INVENTION

The present invention relates to a perpetual calendar, and particularly to an improved perpetual calendar structure.

For a conventional perpetual calendar, it is necessary to replace the date, month and weekday display boards manually everyday. Hence, negligence to replace any of them timely will cause confusion or mistake. Therefore, such a perpetual calendar is not satisfactory.

Though there are improvements on the conventional perpetual calendar for automatic replacement of date, month and weekday display boards, a sophisticated mechanical structure with a micro switch is involved, which means that a lot of parts and a high production cost are required. Therefore, none of the improvements is satisfactory.

SUMMARY OF THE INVENTION

In view of the above defects, the inventor has created an improved perpetual calendar structure which can replace date, month and weekday display plates automatically without the need for manual replacement involving a simple mechanical structure in combination with a limit switch. The structure is simple, the production cost is low, and its possibility of breakdown is very low. Moreover, the displays can be arranged at either the left or right side of the calendar, and the size of any display can be designed at discretion.

BRIEF DESCRIPTION OF THE INVENTION

These and other objects and features of the invention will become more apparent from the following description taken in connection with the accompanying drawings wherein.

DETAILED DESCRIPTION OF THE PREFERRED EMBODIMENT

Figure 1:
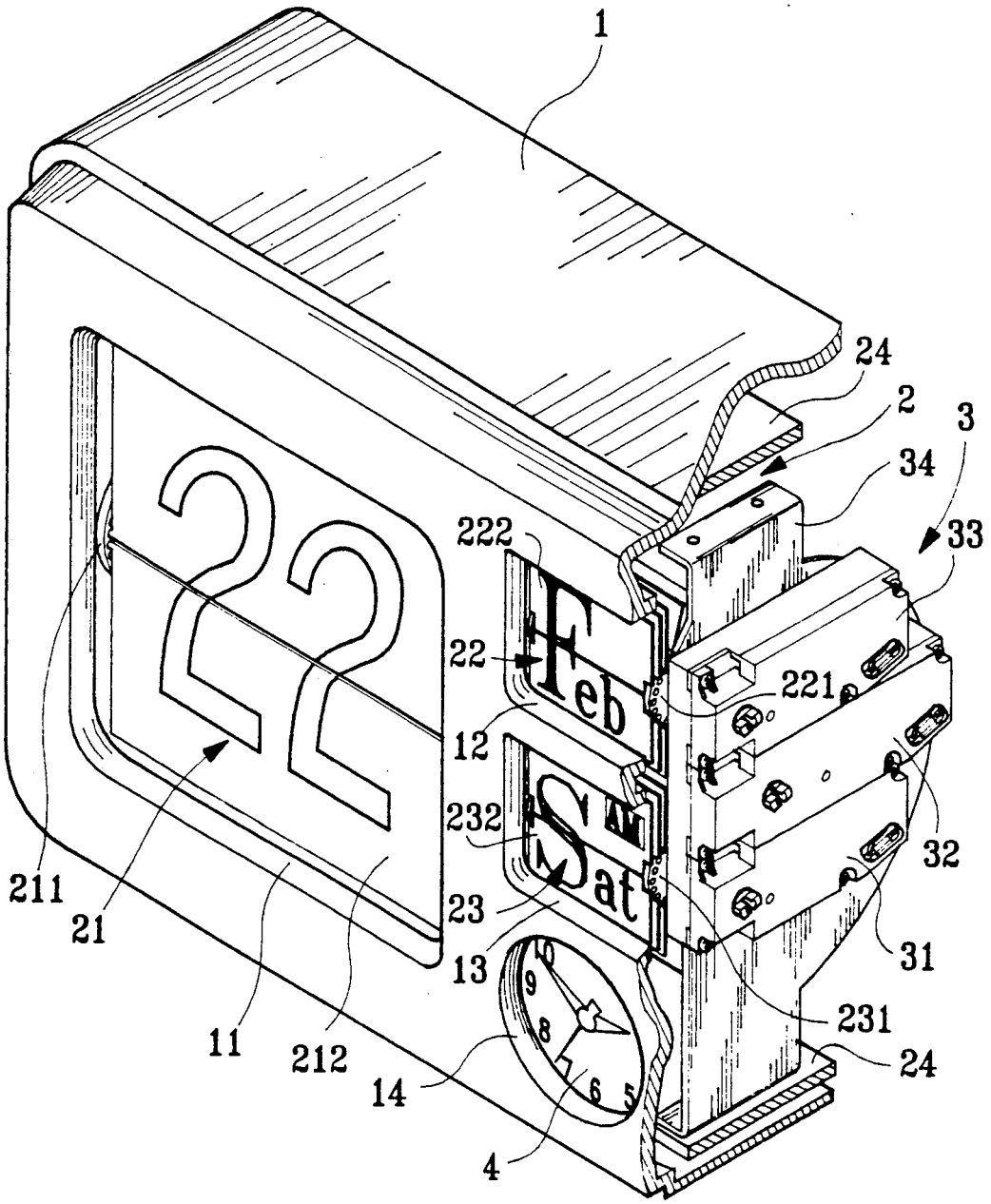
FIG. 1 is a sectional view illustrating an improved perpetual calendar structure according to the present invention.

Please refer to FIG. 1. The perpetual calendar according to the present invention comprises an outer casing (1), an internal frame (2), a driver (3), a clock control (4) and a power source composed of a battery (5). A date indicator window (11), a month indicator window (12), a weekday indicator window (13), and a time indicator window (14) are designed on the outer surface of the outer casing (1). The internal frame (2) is incorporated with a date display set (21), a month display set (22) and a weekday display set (23) each aligning with their corresponding date indicator window (11), month indicator window (12) and weekday indicator window (13) respectively. The clock control (4) is placed to align with the time indicator window (14) as well.

Figure 2:
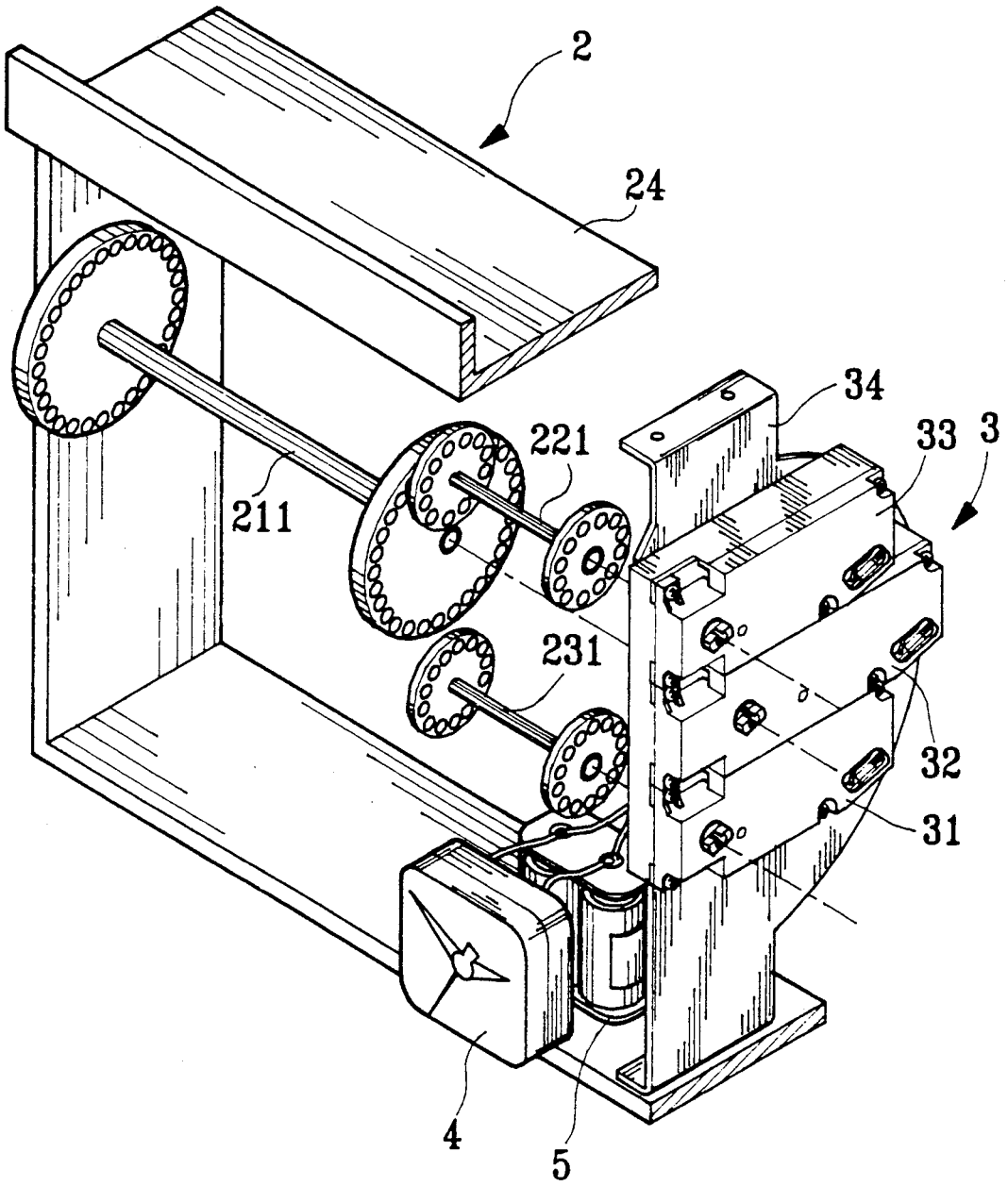
FIG. 2 illustrates an internal structure of the perpetual calendar according to the present invention.

Please refer to FIG. 2. The internal frame (2) is composed of the date display set (21), the month display set (22), the weekday display set (23) and a frame body (24). The date display set (21) comprises a driving shaft (211) and a set of date display plates (212) composed of 31 plates one for each day. The date display plates (212) are incorporated with the driving shaft (211), then fixed at the middle of the left side of the frame body (24), and can be rotated freely. The month display set (22) comprises a driving shaft (221) and 12 month display plates (222). The month display plates (222) are incorporated with the driving shaft (221), then fixed at the top of the right side of the frame body (24), and can be rotated freely. The weekday display set (23) comprises a driving shaft (231) and 14 weekday display plates (232). Two weekday display plates (232) are used per day, one to show weekday with an indication of A.M., and another to show weekday with an indication of P.M. Therefore, all together 14 weekday display plates (232) are used, incorporated with the driving shaft (231), then fixed in the middle of the right side of the frame body (24), and can be rotated freely. The clock control (4) is fixed beneath the right side of the frame body (4). It gives a signal to activate the driver (3) to work at the end of rotation for a complete cycle, i.e., every 12-hour period, and consequently a weekday driver (31) in the driver (3) drives the driving shaft (231) of the weekday display set (23) to rotate so that the next weekday display plate (232) showing weekday and A.M. is displayed. At the end of another cycle or 12-hour period, it gives another signal to activate the driver (3) to cause the weekday driver (31) in the driver (3) to drive driving shaft (231) of the weekday display set (23) to turn so that the next weekday display plate (232) showing the same weekday but with an indication of P.M. is displayed, and simultaneously a date driver (32) to drive the driving shaft (211) of the date display set (21) to turn to the next date display plate (212) to show the correct date. After the date display set (21) has been turned 31 times, a month driver (33) is driven to cause the driving shaft (221) of the month display set (22) to turn to the next month display plate to show the correct month. The control sequence is: When the clock control turns for a cycle of a 12-hour period, the weekday display set (23) turns to the next weekday display plate. When the weekday display set (23) turns every two weekday display plates, the date display set (22) turns to the next date display plate. When the date display set (22) turns every 31 date display plates, the month display set (22) turns to the next month display plate. This cycle is repeated throughout the year. The weekday display set (23), date display set (21) and month display set (22) can be made in the form of respective rolls for cyclic turning.

Figure 3:
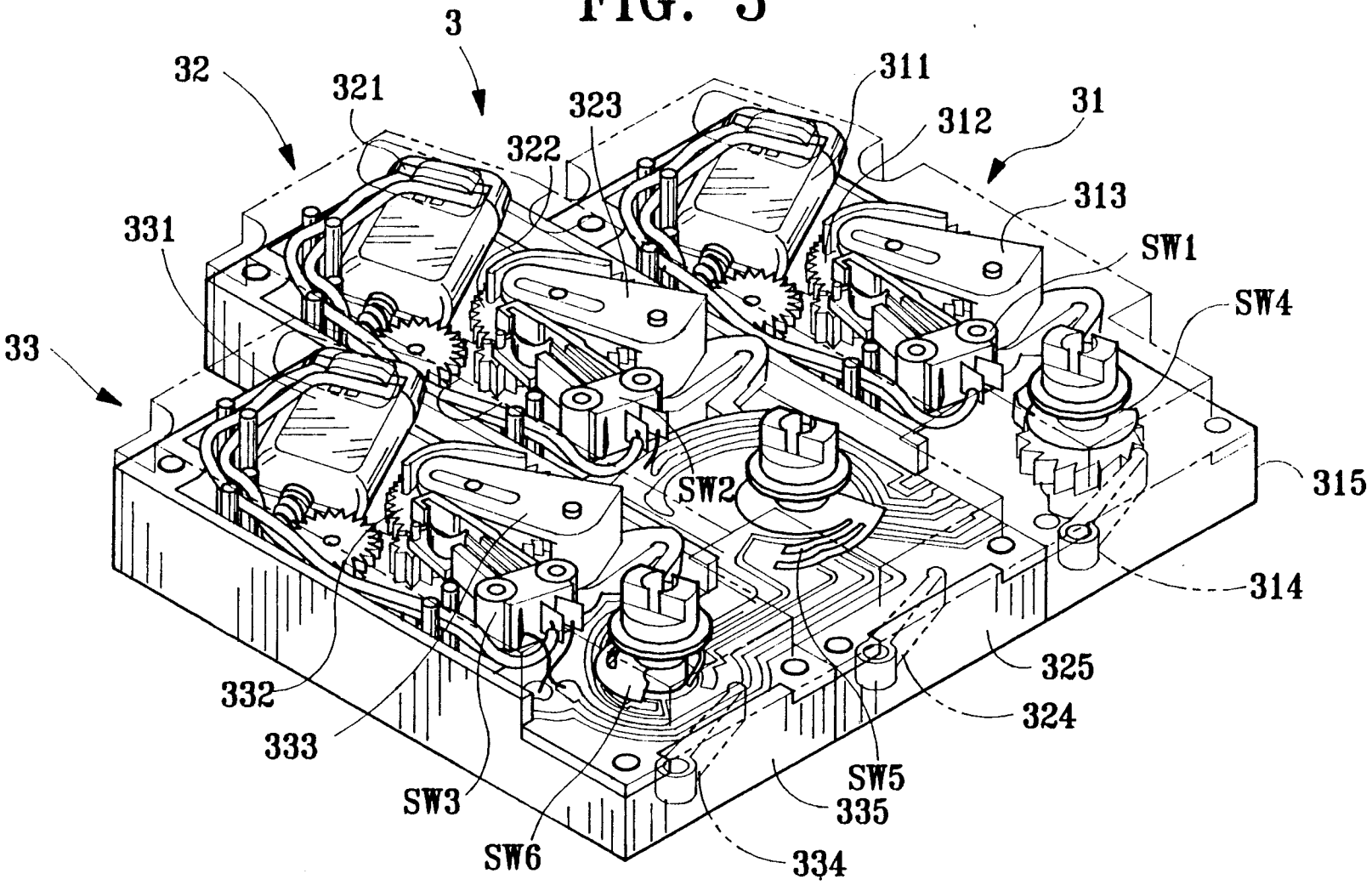
FIG. 3 illustrates a driving mechanism for the perpetual calendar according to the present invention.
Figure 5:
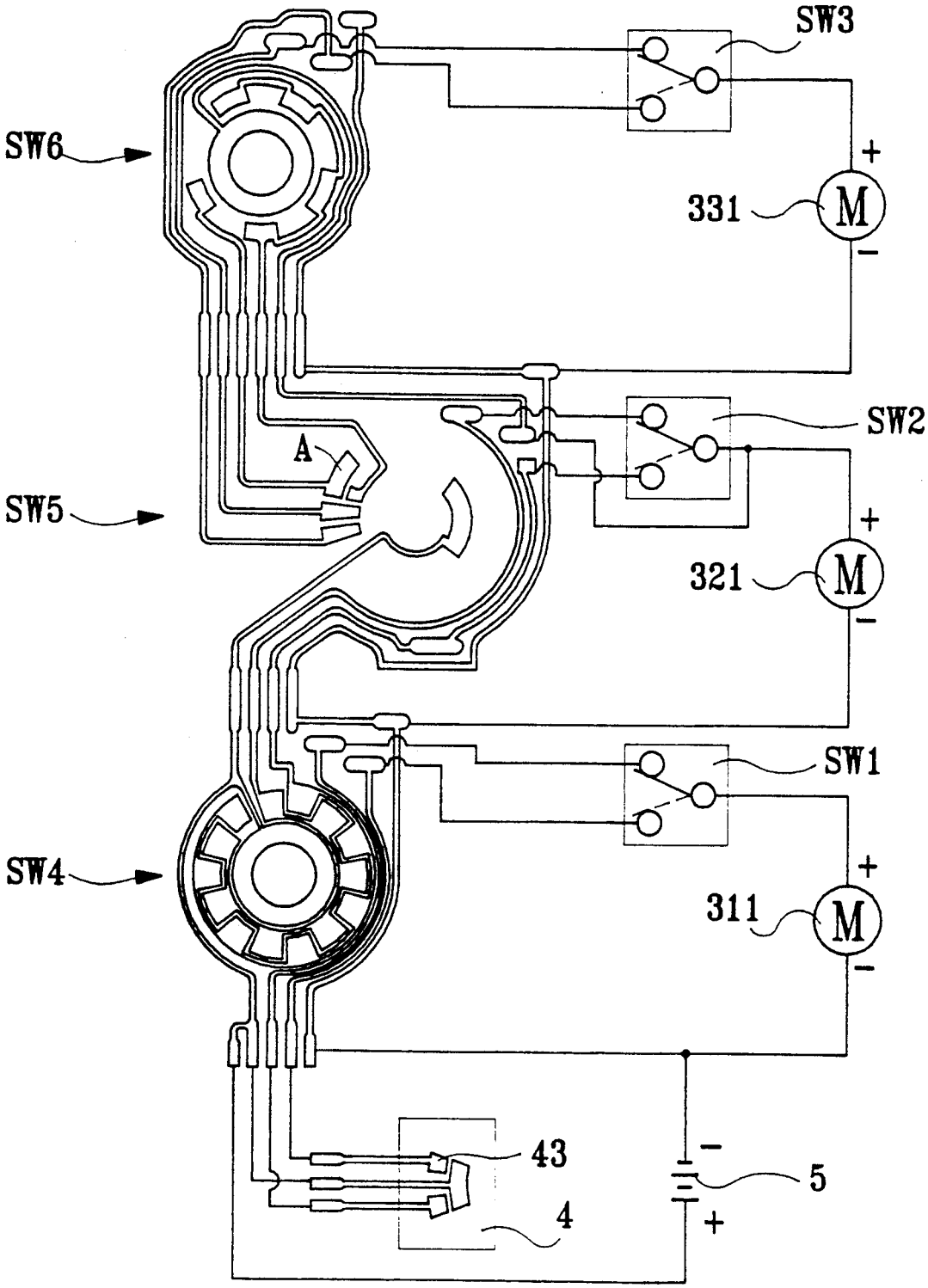
FIG. 5 is a circuit diagram for control of the perpetual calendar according to the present invention.

Please refer to FIG. 3. The driver (3) is composed of the weekday driver (31), the date driver (32), the month driver (33) and a fixing board (34). Each of the weekday driver (31), the date driver (32) and the month driver (33) includes a motor (311, 321 or 331), a gear train (312, 322 or 332), a brake (313, 323 or 333), a limit switch (SW1, SW2 or SW3), a rotary switch (SW4, SW5 or SW6), a positioning lever (314, 324 or 334), and a casing (315, 325 or 335). The motor (311, 321 or 331) is fixed at the right side of the casing (314, 325 or 325), which has the gear train (312, 322 or 332) located at its left side and driven by the motor (311, 321, or 331). The brake (313, 323 or 33) is fixed between the gear train (312, 322, or 332) and the rotary switch (SW4, SW5 or SW6), and subjected to control of the gear (312, 322 or 332) in order to control rotation of the rotary switch (SW4, SW5 or SW6). The limit switch (SW1, SW2 or SW3) above is subject to the control of the gear train (312, 322 or 332) as well to control the contact point of the rotary switch (SW4, SW5 or SW6) on a circuit board so that the rotary switch can rotate only for a certain angle at each activation, and then be positioned by the positioning lever (314, 324 or 334) at the left side. For the weekday driver (31), there are 14 contacts arranged in 14 equal intervals. Then, upon rotating for two intervals, the date driver (32) is turned for an interval among a cycle of 31 intervals. The date driver (32) is for a cycle of 31 intervals but it has only a contact at the 31st interval. Hence, when it is turned to the 31st interval, the month driver (33) is driven to turn for an interval. The month driver (33) is for a cycle of 12 intervals with five contacts—no contact for January, a contact for February, no contact for March, a contact for April, no contact for May, a contact for June, no contact for July, no contact for August, a contact for September, no contact for October, a contact for November, and no contact for December. Hence, during April, June, September and November, the date driver (32) can skip over the 31st day and display the 1st day, and during February the date driver (32) can skip over the 29th day, 30th day and 31st day, and display the 1st day automatically with a circuit as shown in FIG. 5.

Figure 4:
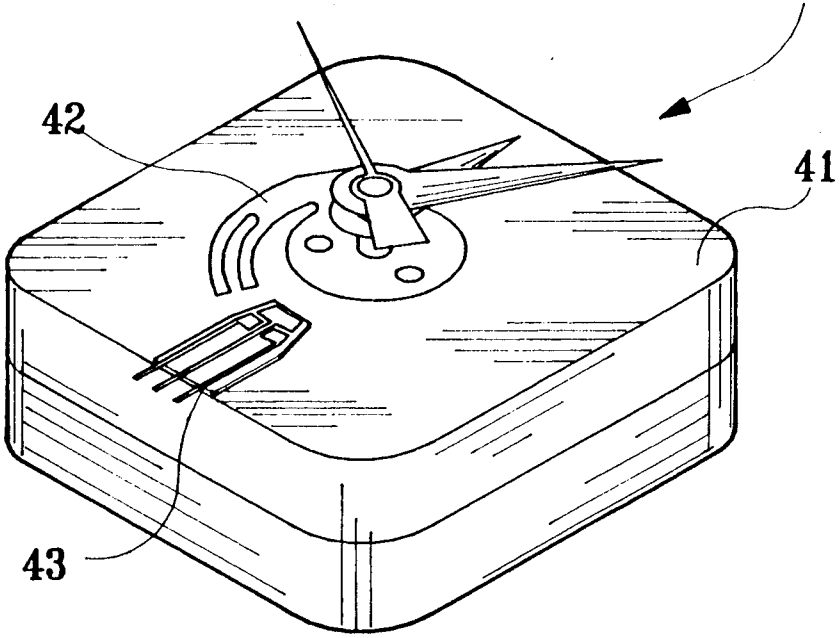
FIG. 4 illustrates control of the perpetual calendar according to the present invention.

Please refer to FIG. 4, the clock control (4) comprises a clock (41), a rotary contact plate (42) and a control circuit board (43). The rotary contact plate (42) is fixed to the shaft of the hour hand, and rotates following rotation of the hour hand. The control circuit board (43) is fixed beneath the rotary contact plate (42) and maintains contact with the rotary contact plate (42). The control circuit board (43) has a contact at 12 o'clock position in order to give a signal to activate the driver (3) in the end of each rotation of 12-hour period.

As described above, the present invention provides a perpetual calendar which can change date, weekday and month automatically without manual replacement. A circuit board is used as a controller to replace the conventional mechanical switch and micro-switch. By incorporation of some mechanical movements, it has a simple structure with accurate operation and low fault possibility. Moreover, its structure is flexible, its display can be placed either at the left or right side, and the length of display can be controlled at discretion.

Many changes and modifications in the above described embodiment of the invention can, of course, be carried out without departing from the scope hereof. Accordingly, to promote the progress in science and the useful arts, the invention is disclosed and is intended to be limited only by the scope of the appended claims.

What is claimed is:

1. An improved perpetual calendar structure comprising:

an outer casing with a hollow interior space and windows for display of date, month, weekday and time on its external surface;

an internal frame composed of a date display set, a month display set, a weekday display set, and a frame body, wherein each of the display sets includes a display plate and is rotatably fixed to the frame body and secured within the outer casing with the respective display plates aligning with the respective windows on the outer casing, wherein said weekday display set is composed of 14 display plates, said date display set is composed of 31 display plates, and said month display set is composed of 12 plates;

A driver composed of a weekday driver, a date driver and month driver fixed to a fixing board within the outer casing to drive the weekday display set, date display set and month display set respectively;

a clock control, located in the outer casing, composed of a clock, a rotary contact plate and a control circuit board arranged in such a manner that the rotary contact plate is fixed to a shaft of an hour hand of the clock for rotation following movement of the hour hand so that a signal is given at an end of each rotation of a 12-hour period by contacting a contact located at a 12 o'clock position of the control circuit board in order to activate the driver; and a battery located within the outer casing to provide power to control circuit; and means for generating a signal upon completion of a rotation for the 12-hour period to activate the weekday driver to turn the weekday display set to a next plate showing a weekday and A.M. or P.M., activate the date driver to turn the date display set to a next plate whenever two plates of the weekday display set representing a whole day have turned, and activate the month driver to turn the month display set to a next plate when 31 plates of the date display set have been turned in order to display month, date and weekday automatically.

2. An improved perpetual calendar structure as claimed in claim 1, wherein the month displace set, date display set and weekday driver set can be either a loose-leaf page type or a roll type display.

3. An improved perpetual calendar structure as claimed in claim 1, wherein each of the month driver, date driver and weekday driver is composed of a motor, a gear train, a brake, a limit switch, a rotary switch, a positioning lever, and a casing, in which the motor is fixed at the right side of the casing, the gear train is located at its left side and driven by the motor, the brake is fixed between the gear train and the rotary switch, and subjected to control of the gear in order to control rotation of the rotary switch, the limit switch being subject to control of the gear train as well as to control a contact point of the rotary switch on a circuit board so that the rotary switch can rotate only for a certain angle at each activation, the switch being arranged to be positioned by the positioning lever at the left side; and wherein the weekday driver includes 14 contacts arranged in 14 equal intervals such that upon rotating for two intervals, the date driver is turned for an interval among a cycle of 31 intervals, the date driver having only a single contact at the 31st interval and hence when it is turned to the 31st interval, the month driver is driven to turn for an interval; the month driver having a cycle of 12 intervals with five contacts as follows: no contact for January, a contact for February, no contact for March, a contact for April, no contact for May, a contact for June, no contact for July, no contact for August, a contact for September, no contact for October, a contact for November, and no contact for December, so that during April, June, September and November, the date driver can skip over the 31st day and display the 1st day, and during February the date driver can skip over the 29th day, 30th day and 31st day and display the first day automatically.

* * * * *